United States Patent [19]

Tebaldi

[11] 4,400,892

[45] Aug. 30, 1983

[54] TONGS HAVING A REMOVABLE ABSORBENT LINING FOR DRYING THE HANDLES OF TENNIS RACKETS AND SIMILAR

[76] Inventor: Jacques Tebaldi, 34 route de Tours, 41400 Saint Georges Sur Cher, France

[21] Appl. No.: 270,067

[22] Filed: Jun. 3, 1981

[30] Foreign Application Priority Data

Jun. 4, 1980 [FR] France ..... 80 12421

[51] Int. Cl.[3] ..... B43L 17/04

[52] U.S. Cl. ..... 34/95.1

[58] Field of Search ..... 34/9, 95, 95.1, 95.2

[56] References Cited

U.S. PATENT DOCUMENTS 2,235,699 3/1941 Dickson ..... 34/95.1 X

FOREIGN PATENT DOCUMENTS 637147 5/1950 United Kingdom ..... 34/95

*Primary Examiner*—Chris K. Moore

*Attorney, Agent, or Firm*—William A. Drucker

[57] ABSTRACT

A device for drying a prismatic object, comprising two jaws (1, 2) hinged about a common pin (3) and each extended by a handle forming a lever (6, 7), each of these jaws defining a cavity (4, 5) for housing an absorbent lining.

Application to the drying of tennis racket handles.

5 Claims, 2 Drawing Figures

TONGS HAVING A REMOVABLE ABSORBENT LINING FOR DRYING THE HANDLES OF TENNIS RACKETS AND SIMILAR

BACKGROUND OF THE INVENTION

The leather or other element for protecting the handle of a tennis racket becomes damp through sweating of the hands and there exists no device for conveniently drying it during the game.

SUMMARY OF THE INVENTION

The invention relates to a device in the form of tongs provided with an absorbent lining, more especially intended for drying the handles of rackets, or other objects of prismatic shape.

OBJECT OF THE INVENTION

According to the invention, this device comprises two jaws hinged about a common pin and each extended by a handle forming a lever, each of these jaws defining a cavity for housing an absorbent lining.

The different features as well as the advantages of the invention will become clear from the following description.

DESCRIPTION OF THE PREFERRED EMBODIMENT

The two jaws 1 and 2, made from an aluminium alloy or other material, are provided with a hinge so as to be able to pivot about a pin 3 and each provides a cavity in the shape of an elongated gutter, 4 and 5 respectively. These two cavities are shaped so that, when the tongs are closed, they assume the shape of the holding zone of the surface of the handle of the racket.

It is then sufficient to introduce a paper handkerchief or other absorbent lining, between each cavity and the handle so as to ensure rapid and efficient drying, the relatively high pressure exerted by the tongs promoting absorption of the liquid exuded on the handle.

In the embodiment described, each cavity is provided with a piece of flexible material (41, 51) fixed by bonding which facilitates the contact of the absorbent lining with the handle.

It is evident that the absorbent lining may be readily replaced when it is soaked with liquid.

Figure 1:
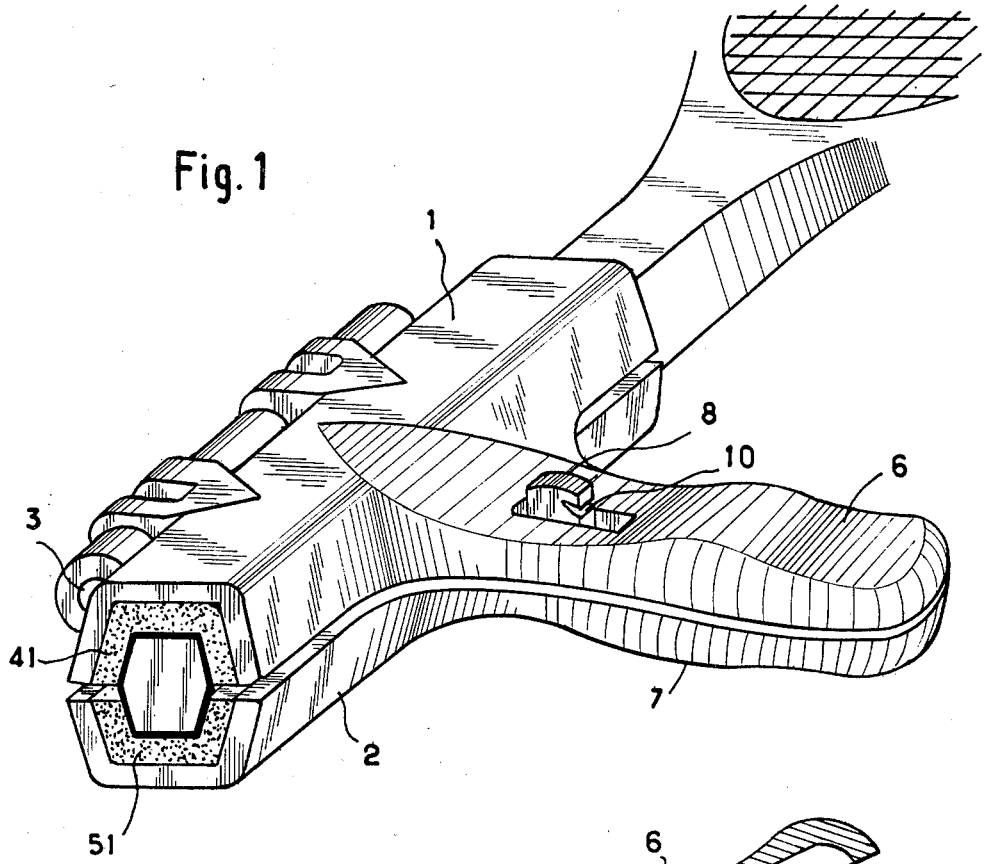
FIG. 1 is a perspective view of a pair of tongs conforming to the preferred embodiment of the invention, closed on the handle of a racket.
Figure 2:
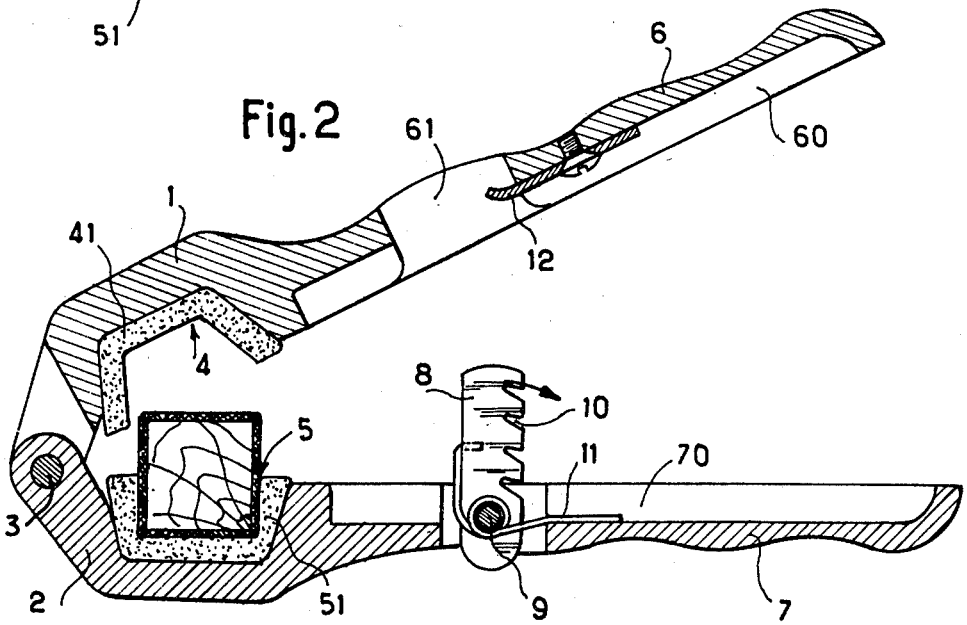
FIG. 2 is a sectional view of these tongs shown in the open position.

Jaws 1,2 are extended by respective handles 6,7 forming levers. The lower lever 7 is advantageously provided with a catch 8 rotatable about a pin 9 and provided with notches 10. A spring 11 fixed at one end to lever 7 and engaged at the other end with catch 8 is adapted so as to urge catch 8 in the direction of the arrow, see FIG. 2, towards the cocked position in which one of the notches 11 cooperates with a resilient blade 12 screwed to the bottom of the recess 60 comprised in lever 6. In this position it can be see (FIG. 1) that catch 9 projects through an aperture 61 provided in lever 6. Continuous clamping for the desired length of time is thus ensured. By exerting a manual pressure on the upper accessible part of catch 8, this latter is released and it retracts, under the action of spring 11 into recess 70 provided in lever 7.

The pressure is adjustable depending on the choice of notch. It will be readily understood that different modifications may be made to the device described and shown, without departing from the spirit of the invention.

I claim:

1. A device for drying racket handles, said device comprising two substantially identical jaws (1, 2) hinged about a common pin (3) and each extended by a handle forming a lever (6, 7), these jaws together defining an elongated cavity (4, 5) opened at both ends, an absorbent lining being housed in said cavity and said cavity being so shaped as to accomodate a substantial portion of the length of a racket handle.

2. A device according to claim 1, characterized in that said absorbent lining is formed by a paper handkerchief placed inside the cavity.

3. A device according to claim 1 or 2, characterized in that each cavity is provided with a resilient material (41, 42) on which the absorbent lining is applied.

4. A device according to claim 1, characterized by a locking member (8, 12) providing continuous clamping for the desired length of time.

5. A device according to claim 4, characterized in that said locking member comprises a pivotable catch (8) having several notches (10) which allow the pressure to be adjusted.

* * * * *